US011340029B2

(12) United States Patent
Stenzel

(10) Patent No.: US 11,340,029 B2
(45) Date of Patent: May 24, 2022

(54) RIFLE WITH HYBRID RECEIVER, MODIFIED TRUNNION, GAS BLOCK AND AMBIDEXTROUS BOLT STOP

(71) Applicant: Joe Stenzel, Maple Grove, MN (US)

(72) Inventor: Joe Stenzel, Maple Grove, MN (US)

( * ) Notice: Subject to any disclaimer, the term of this patent is extended or adjusted under 35 U.S.C. 154(b) by 0 days.

(21) Appl. No.: 16/930,001

(22) Filed: Jul. 15, 2020

(65) Prior Publication Data

US 2022/0018618 A1 Jan. 20, 2022

(51) Int. Cl.

| | |
|---|---|
| ***F41A 3/66*** | (2006.01) |
| ***F41A 3/68*** | (2006.01) |
| ***F41A 5/26*** | (2006.01) |
| ***F41C 23/16*** | (2006.01) |
| ***F41C 23/14*** | (2006.01) |
| ***F41A 35/06*** | (2006.01) |
| ***F41C 7/00*** | (2006.01) |

(52) U.S. Cl.

CPC *F41A 3/66* (2013.01); *F41A 3/68* (2013.01); *F41A 5/26* (2013.01); *F41A 35/06* (2013.01); *F41C 7/00* (2013.01); *F41C 23/14* (2013.01); *F41C 23/16* (2013.01)

(58) Field of Classification Search

CPC ..... F41A 3/66

See application file for complete search history.

(56) References Cited

U.S. PATENT DOCUMENTS

| | | | | |
|---|---|---|---|---|
| 9,777,975 | B2 * | 10/2017 | Folkestad, II | F41C 23/16 |
| 2015/0323271 | A1 * | 11/2015 | McGinty | F41A 3/72 42/17 |
| 2021/0180904 | A1 * | 6/2021 | Bray | F41A 21/48 |

* cited by examiner

*Primary Examiner* — Reginald S Tillman, Jr.

(74) *Attorney, Agent, or Firm* — Bennet K Langlotz; Langlotz Patent & Trademark Works, LLC

(57) ABSTRACT

A modified AK-style rifle including a receiver body with a back end having a first threaded cylindrical cavity and a second cylindrical cavity located below the first threaded cylindrical cavity. A lower portion below the first threaded cylindrical cavity has a width that is narrower than the upper receiver section to allow for passage of a pair of parallel and opposing telescoping bars on each side. A trunnion is connected to the receiver front end and an ambidextrous bolt stop is attached to the receiver body. A removable stock is coupled to the first threaded cylindrical cavity. A first bolt carrier rail is attached to a first side wall of the receiver body and a second bolt carrier rail is attached to a second side wall of the receiver body. A bolt carrier slidingly bears on the first bolt carrier rail and the second bolt carrier rail. A gas block includes a short stroke gas piston aligned with the bolt carrier section.

11 Claims, 23 Drawing Sheets

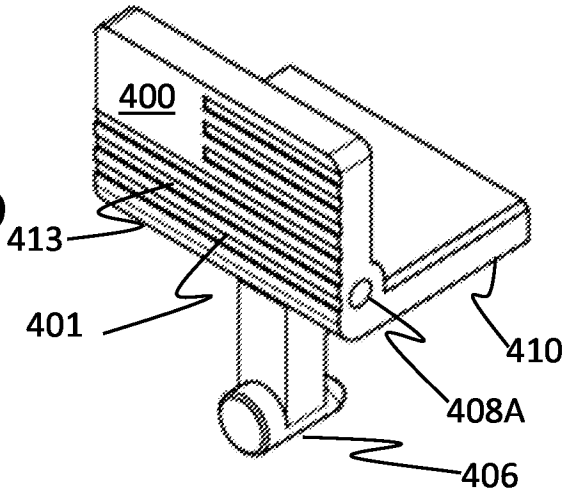
FIG. 12F
FIG. 12D
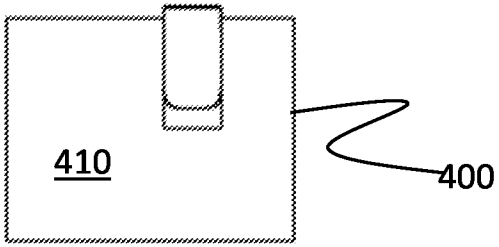
FIG. 12C
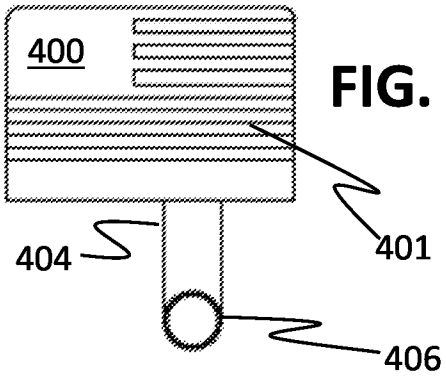
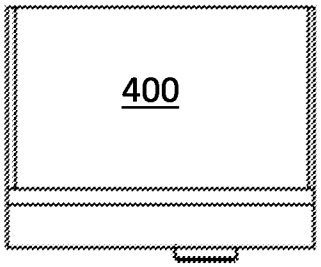
FIG. 12E
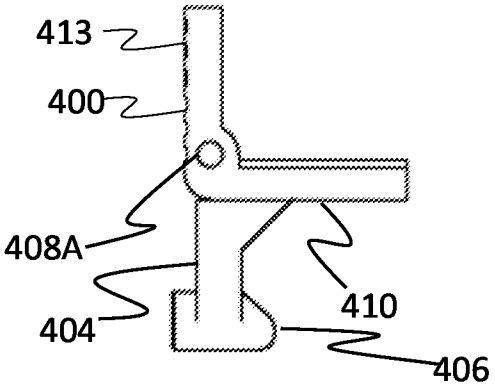
FIG. 12B 86
87
93
80

89
80

534
86
136
80

91
89
80

86
87
93
80
91
89

86
91
89
136
81
80
81

87
91
93
89
81

RIFLE WITH HYBRID RECEIVER, MODIFIED TRUNNION, GAS BLOCK AND AMBIDEXTROUS BOLT STOP

TECHNICAL FIELD

The present invention relates to firearms and, more particularly, to an AK-style automatic or semi-automatic rifle with a hybrid receiver, modified trunnion, modified gas block and ambidextrous bolt stop.

BACKGROUND

Currently lacking for AK-style rifles is a rifle having a hybrid receiver that allows attachment of an AR-15 variant PDW style stock. PDW style stocks feature a collapsing or telescoping AR-style stock the attachment of which is currently not possible due to known AK-style receiver construction.

Other features not found in the state of the art are described herein in the detailed description including an ambidextrous bolt block mechanism, a modified trunnion, bolt carrier rails allowing lighter weight construction and a short stroke gas block offer advantages in use of an AK-style rifle.

BRIEF SUMMARY OF THE DISCLOSURE

This summary is provided to introduce, in a simplified form, a selection of concepts that are further described below in the Detailed Description. This summary is not intended to identify key features of the claimed subject matter, nor is it intended to be used as an aid in determining the scope of the claimed subject matter.

In one example a modified AK-style rifle includes a receiver body including a front end, a back end, a first side wall and a second side wall parallel to and opposite the first side wall; wherein the back end includes a first threaded cylindrical cavity and a second cylindrical cavity located below the first threaded cylindrical cavity. A lower portion of the receiver walls below the first threaded cylindrical cavity have a width that is narrower than the upper receiver section constructed to allow for passage of one of a pair of parallel and opposing telescoping bars on each side of the receiver; opposing magazine guides are constructed to be parallel to each other and spaced apart to accommodate supporting a magazine release between them. A trunnion is connected to the receiver front end and an ambidextrous bolt stop is attached to the receiver body. A removable stock is coupled to the first threaded cylindrical cavity. A rifle barrel with a rearward end is connected to the trunnion. A muzzle is attached to the forward end of the rifle barrel, and a magazine well is integrated into the receiver body. A first bolt carrier rail is attached to a first side wall of the receiver body and a second bolt carrier rail is attached to the second side wall of the receiver body. A bolt carrier slidingly bears on the first bolt carrier rail and the second bolt carrier rail. A gas block is attached to the rifle barrel, wherein the gas block includes a short stroke gas piston aligned with the bolt carrier section; and a pistol grip is attached to a bottom surface of the receiver body.

BRIEF DESCRIPTION OF THE DRAWINGS

While the novel features of certain embodiments of the invention are set forth with particularity in the appended claims, the invention, both as to organization and content, will be better understood and appreciated, along with other objects and features thereof, from the following detailed description taken in conjunction with the drawings, in which:

FIG. 12B schematically shows an example of a side view of a bolt stop.

FIG. 12C schematically shows an example of a bottom plan view of a bolt stop.

FIG. 12D schematically shows an example of a front plan view of a bolt stop.

FIG. 12E schematically shows an example of a top view of a bolt stop.

FIG. 12F schematically shows an example of a perspective view of a bolt stop.

Figure 1:
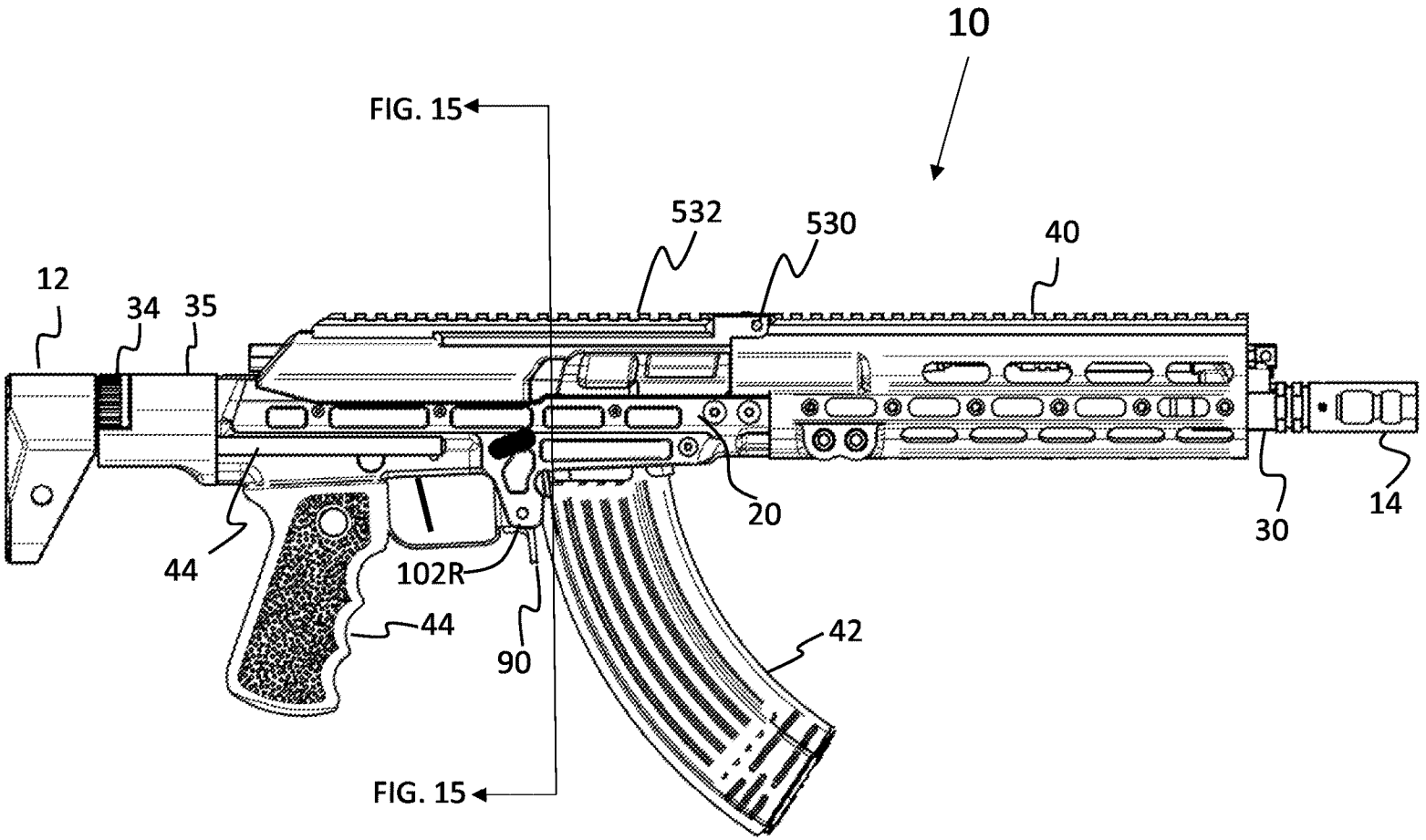
FIG. 1 schematically shows an example of a modified rifle with a hybrid receiver and ambidextrous bolt stop with a PDW stock in a collapsed position.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

The following disclosure describes a modified AK-style semi-automatic rifle. Several features of devices and assemblies in accordance with example embodiments are set forth and described in the figures. It will be appreciated that devices and assemblies in accordance with other example embodiments can include additional components, devices or features different than those shown in the figures. Example embodiments are described herein with respect to an AK-style semi-automatic rifle with a modified carrier, modified gas block, modified trunnion, and ambidextrous bolt stop. However, it will be understood that these examples are for illustrating the principles, and that the invention is not so limited.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example," "an example embodiment," "one embodiment," "an embodiment" or combinations and/or variations of these terms means that a particular feature, structure or characteristic described in connection with the embodiment or example is included in at least one embodiment or example of the present disclosure. Thus, the appearances of the phrases "in one example" or "in an example" in various places throughout this specification are not necessarily all referring to the same example embodiment or example. Furthermore, the particular features, structures, or characteristics may be combined in any suitable manner in one or more embodiments or examples.

Definitions

Generally, as used herein, the following terms have the following meanings:

The articles "a" or "an" and the phrase "at least one" as used herein refers to one or more.

As used herein, "plurality" is understood to mean more than one. For example, a plurality refers to at least two, three, four, five, ten, 25, 50, 75, 100, 1,000, 10,000 or more.

The term "AK-style rifle" as used herein means a rifle constructed substantially similar to an Avtomat Kalishnikova, commonly known as the "AK-47" or "Kalishnikov" and its variants.

The term "AR-style rifle" as used herein means a rifle constructed substantially similar to an AR-15 rifle and its variants.

The term "Personal Defense Weapon (PDW)" means a rifle with a telescoping stock as sometimes currently used in an AR-style rifle.

The term "PDW stock" means a telescoping stock as sometimes currently used in an AR-style rifle.

As used herein, "front" or "forward" and "distal" correspond to the end of the rifle nearest the muzzle of the firearm; and "rear", "rearward", "back" or "proximal" correspond to the end of the rifle nearest the stock of the firearm.

"Obtaining" is understood herein as manufacturing, purchasing, or otherwise coming into possession of.

While examples herein referred to "right" and "left" sides, this is by way of example only and it will be understood that components may be assembled in a mirror image fashion exchanging components on the right side with components on the left side in order to provide a left-handed rifle. Such an example is considered to be within the scope of this invention as claimed.

Example Embodiments

Figure 3:
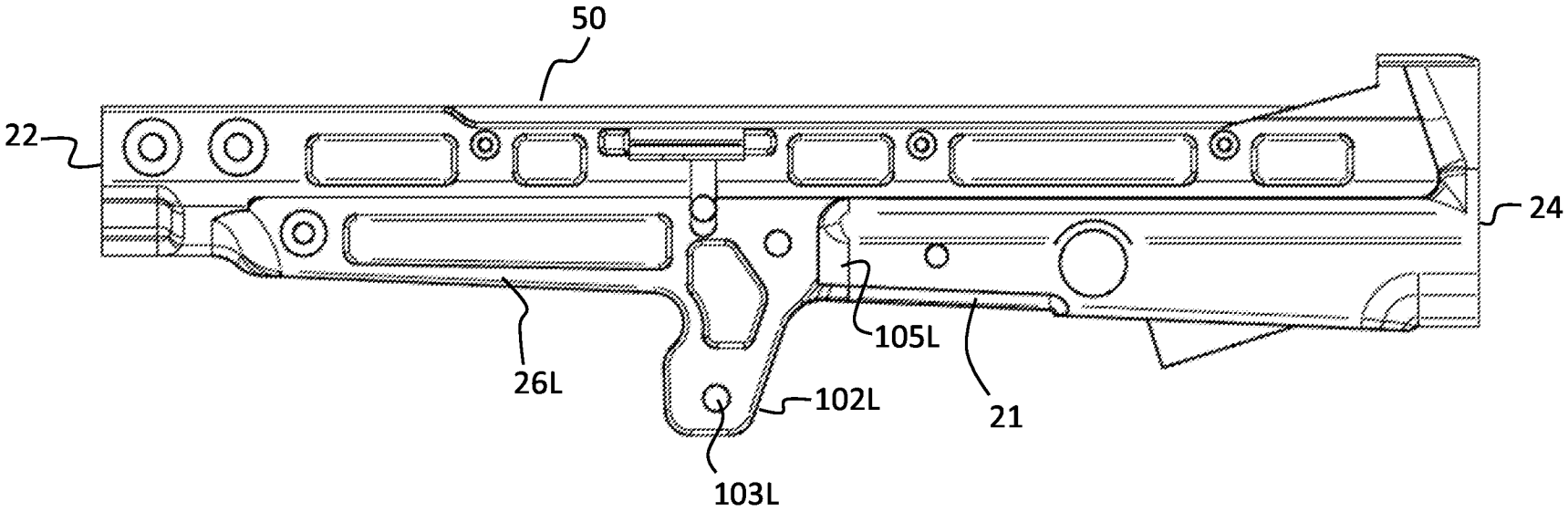
FIG. 3 schematically shows an example of a left side plan view of a hybrid receiver body.

Referring now to FIG. 1, an example of a modified rifle with a hybrid receiver and ambidextrous bolt stop with a PDW stock in a collapsed position is schematically shown. A modified rifle 10 includes a hybrid receiver 20, a stock 12, a rifle barrel 30, a muzzle 14 attached to the forward end of the rifle barrel, a hand guard 40, a magazine 42 and a pistol grip 44. Opposing magazine guides 102L (as shown in FIG. 3), 102R provide support for a magazine release 90. As will be further explained below, the stock 12 may comprise a collapsing or telescoping AR-style PDW stock the attachment of which is made possible due to the hybrid receiver construction as described in more detail below. The PDW stock 12 is attached to a buffer tube 34, which, in turn, is screwed into the back end of the hybrid receiver 20.

Figures 16A, 16B, 16C, 16D, 16E, 16F, 16G:
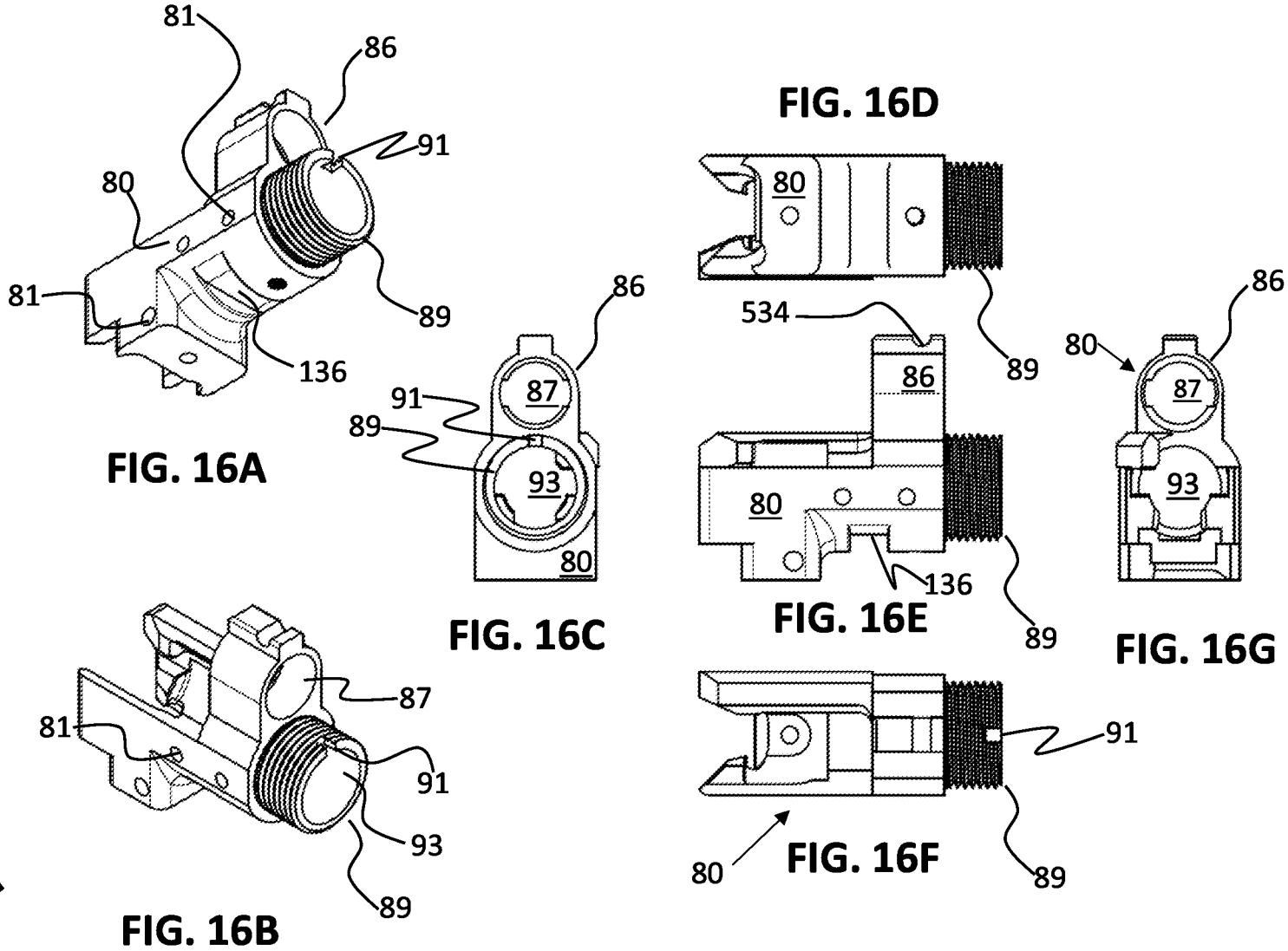
FIG. 16A schematically shows an example of a bottom perspective view of a modified trunnion.
FIG. 16B schematically shows an example of a top perspective view of a modified trunnion.
FIG. 16C schematically shows an example of a front plan view of a modified trunnion.
FIG. 16D schematically shows an example of a bottom plan view of a modified trunnion.
FIG. 16E schematically shows an example of a side view of a modified trunnion.
FIG. 16F schematically shows an example of a top plan view of a modified trunnion.
FIG. 16G schematically shows an example of a back plan view of a modified trunnion.

Also shown are pin 530 and rail dust cover 532. The pin 530 is inserted through the end of the rail dust cover 532, the hand guard 40 and is supported by a trunnion channel 534 (as best shown in FIG. 16E). The pivot point created by the pin 530 connects the rail dust cover 532 to the AK-style rifle, supporting the rail dust cover 532 with the trunnion 80 (as shown, for example in FIG. 16E) and allowing the rail dust cover 532 to be opened towards the muzzle in an arcuate fashion without removing the rail dust cover.

Figure 1A:
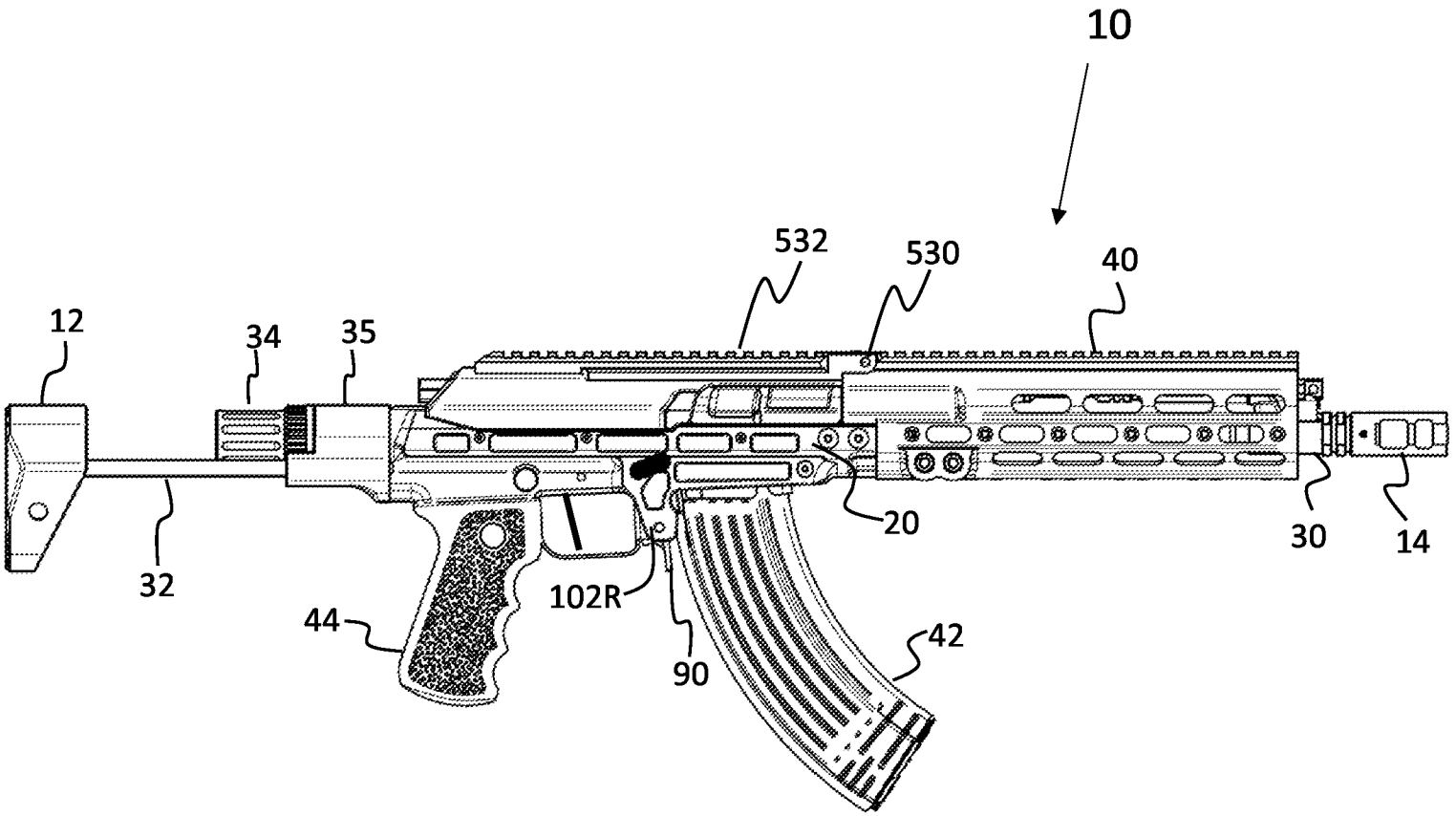
FIG. 1A schematically shows an example of the modified rifle of FIG. 1 with a PDW stock in an extended position.

Referring now to FIG. 1A, an example of the modified rifle of FIG. 1 with a PDW stock in an extended position is schematically shown. The PDW stock 12 is attached by a parallel pair of telescoping rods 32 attached to the buffer tube 34 and extendable along the right and left sides of the hybrid receiver 20.

Figure 2:
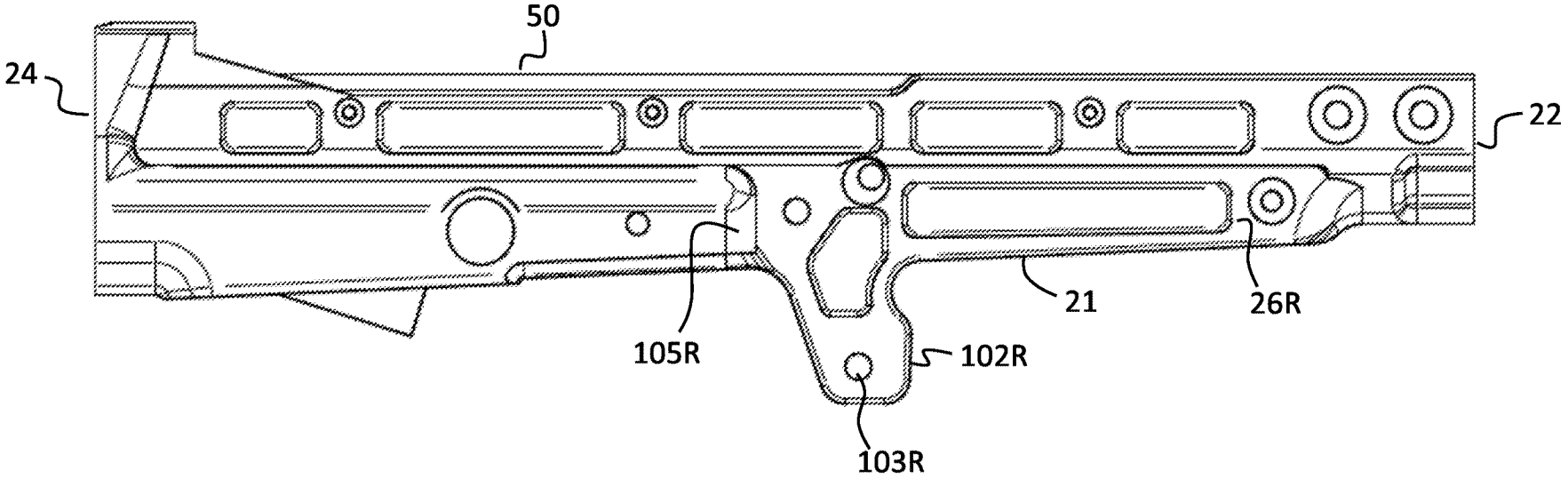
FIG. 2 schematically shows an example of a right side plan view of a hybrid receiver body.

Referring now to FIG. 2, an example of a right side plan view of a hybrid receiver body is schematically shown. A hybrid receiver body 21 includes a front end 22, a back end 24, a right side wall 26R and a right magazine release guide 102R.

Referring now to FIG. 3, an example of a left side plan view of a hybrid receiver body is schematically shown. The hybrid receiver body 21 further includes a left side wall 26L and a left magazine release guide 102L. The magazine guides 102R, 102L are constructed to be parallel to each other and spaced apart to accommodate supporting the magazine release 90 between them (shown in FIG. 1, for example). In one useful example the hybrid receiver body 21 is constructed from aluminum using standard machine tooling and/or fabrication processes. The magazine guides 102R, 102L are integrated into the hybrid receiver body 21. Circular apertures 103L, 103R are provided for attaching the magazine release 90 using a cylindrical rod. The magazine release 90 is attached in a manner so as to pivot between the magazine guides 102R, 102L.

In one useful embodiment, the magazine guides 102R, 102L each protrude downwardly from the hybrid receiver body slanted towards the front end 22 such that the slant is slightly greater than 90° with respect to a top horizontal surface 50 extending from the front 22 of the hybrid receiver body 21.

Figure 4B:
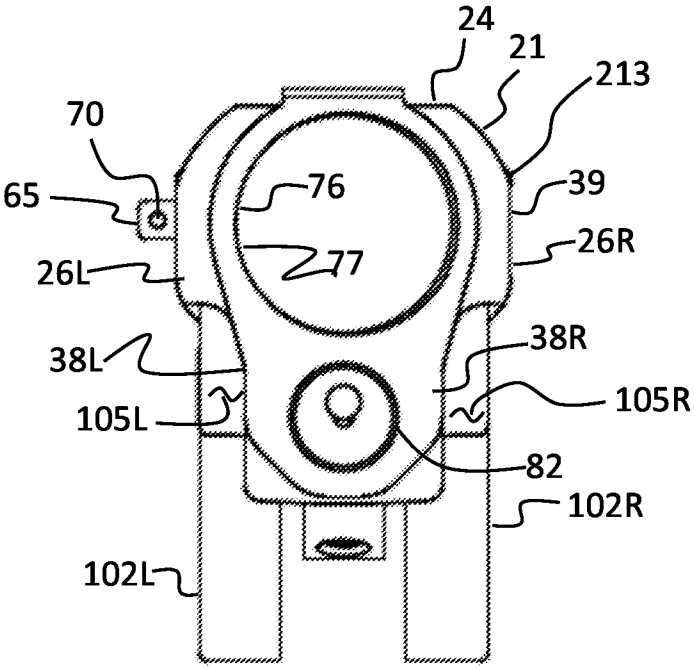
FIG. 4B schematically shows an example of a back view of a hybrid receiver body.
Figure 4A:
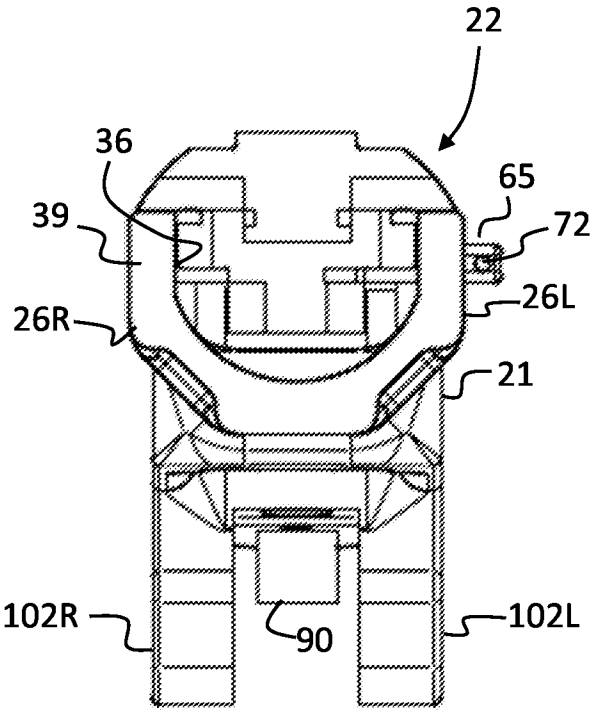
FIG. 4A schematically shows an example of a front view of a hybrid receiver body.

Referring now to FIG. 4A, an example of a front view of a hybrid receiver body is schematically shown. The front end 24 includes a trunnion connection section 36. An opposing pair of front and back protruding bolt stop pin blocks 65 are integrally attached to the left side wall 26L. Each of the protruding bolt stop pin blocks 65 include a circular pin aperture 72 aligned with each other so as to allow a rod or pin to be inserted therethrough.

Referring now to FIG. 4B, an example of a back view of a hybrid receiver is schematically shown. The back end 24 includes A first threaded cylindrical cavity 76 is constructed in an upper receiver section 213 and a second cylindrical cavity 82 located below the first threaded cylindrical cavity 76 is constructed on the back end. A right lower portion of the right side wall 38R opposite a left lower portion 38L of the left side wall are configured below the first threaded cylindrical cavity wherein the width between the right lower portion and the left lower portion is narrower than the upper receiver section and each is constructed to allow for passage of one of a pair of parallel and opposing telescoping rods 32.

Figure 4C:
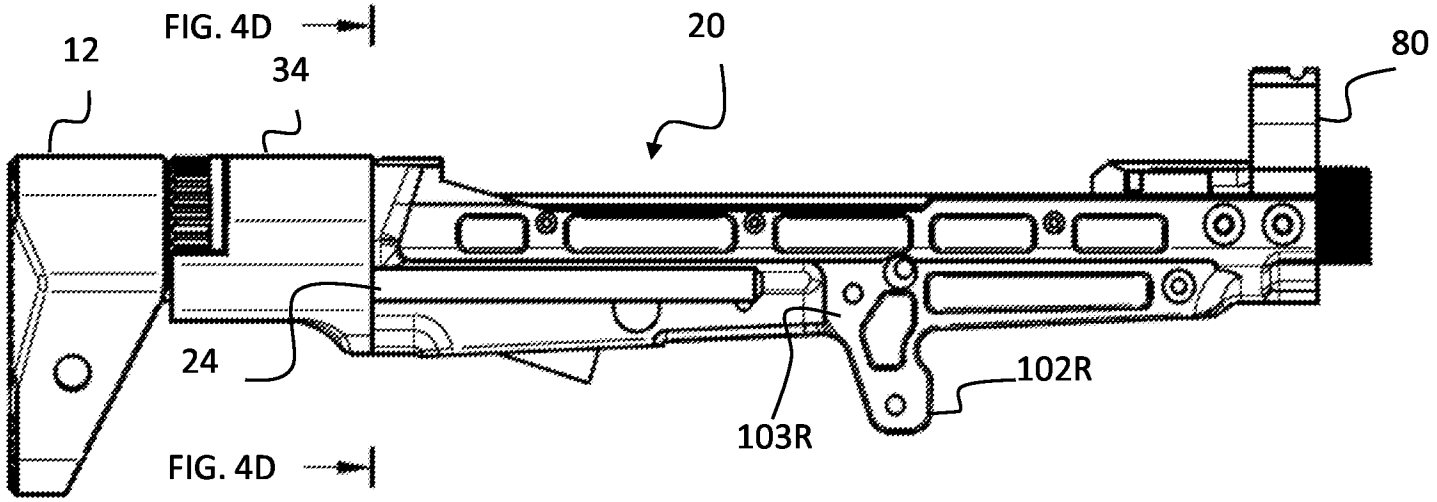
FIG. 4C schematically shows an example of a side view of a modified rifle with a collapsible PDW stock installed.
Figure 4D:
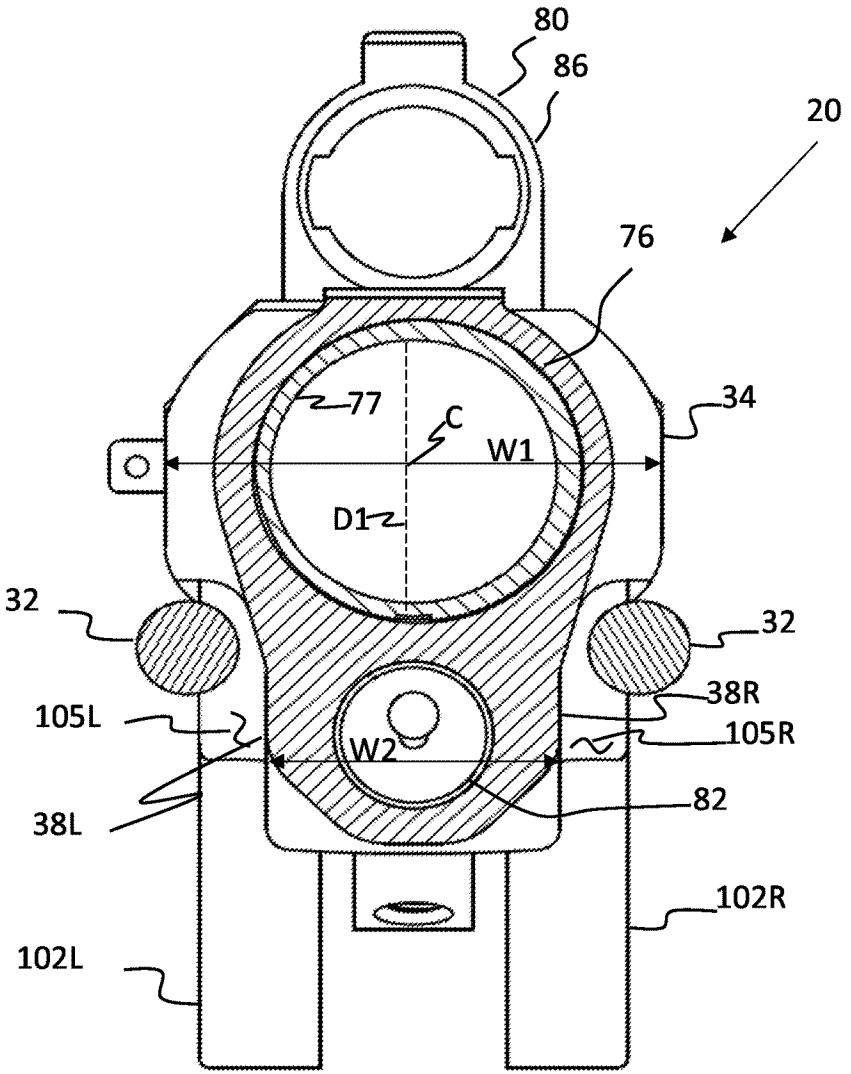
FIG. 4D schematically shows an example of a cutaway back view of a hybrid receiver with a PDW stock installed.

Referring now jointly to FIG. 4C and FIG. 4D, FIG. 4D shows a cutaway back view of a hybrid receiver with a PDW stock installed as indicated in FIG. 4C which schematically shows an example of a side view of a modified rifle with a collapsible PDW stock installed. The back end 24 of the hybrid receiver body 21 is recessed on both right and left sides to allow for passage of a pair of parallel and opposing telescoping bars 32. In one embodiment, the telescoping bars comprise part of in AR-15 or other AR-style telescoping butt stock. The upper receiver section 39 has a first maximum width W1 and the portion of the receiver walls 38 has a second maximum width W2, the first maximum width W1 being greater than the second maximum width W2.

Figure 6:
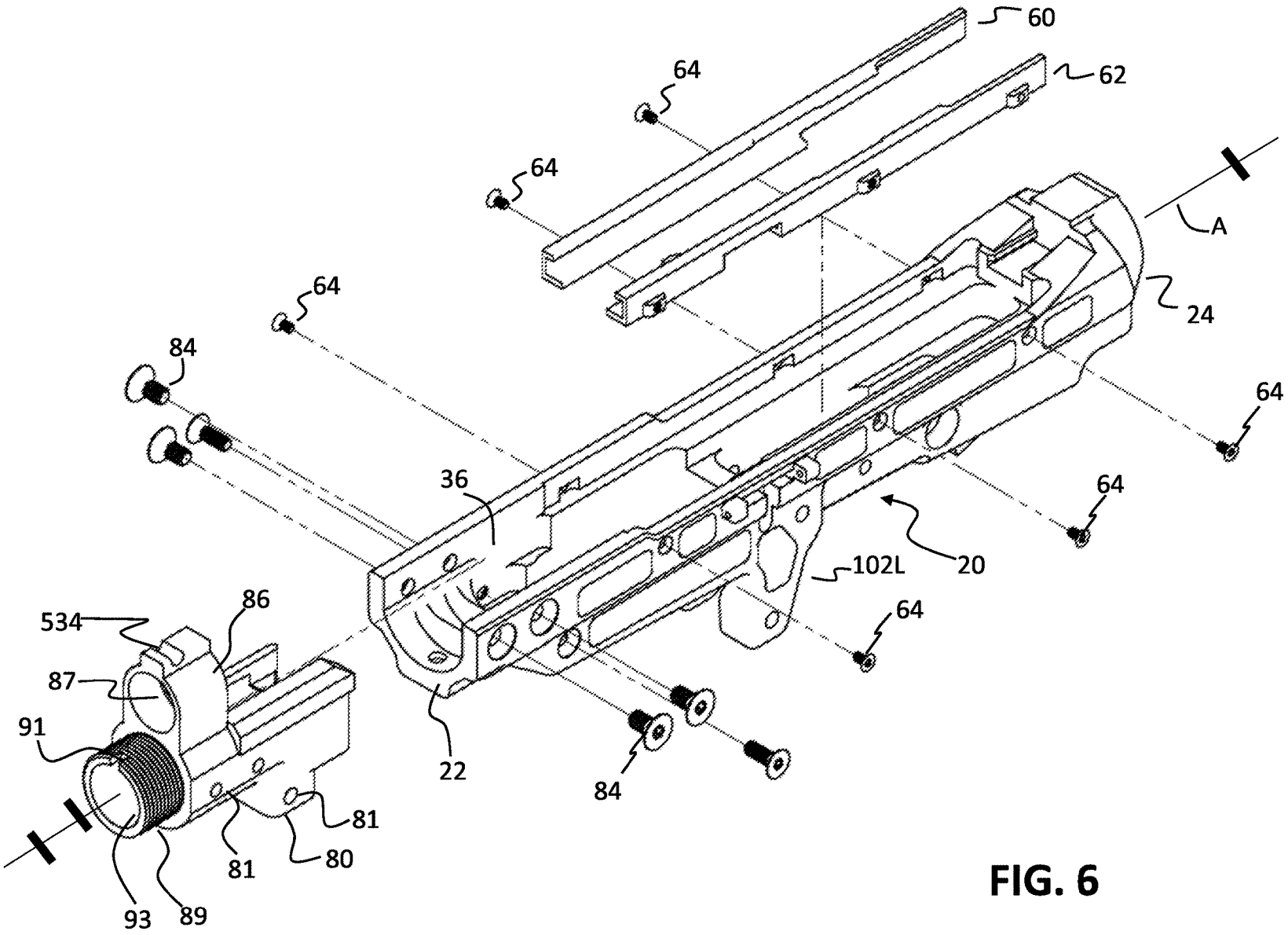
FIG. 6 schematically shows an exploded view of an example of components assembled into a hybrid receiver including a trunnion and bolt carrier receiver rails.

The threaded cylindrical cavity 76 has threaded interior sidewalls 77, a diameter D1, and a center C, with an axis A (as best shown in FIG. 6) extending through the center C and perpendicular to the front and back surfaces 22, 24. In one example, the diameter D1 measures about 35.6 mm. The threaded cylindrical cavity 76 extends inwardly from 0.3 inches to 0.6 inches along the axis A, and in one useful embodiment extends inwardly about 0.5 inches along the axis A.

In order to allow for insertion of the PDW stock opposing telescoping bars 32, the lower receiving walls 38R, 38L extend substantially perpendicular to the back surface 24 to a back upper edge 105R, 105L of each of the opposing magazine guides. In one example the lower receiving section may have a length in the range of about 3.0 to 4.5 inches and a width W2 of less than about 29.3 mm, pref. about 26 mm for example, or a width similar to an AR-15 lower receiver.

Figure 5A:
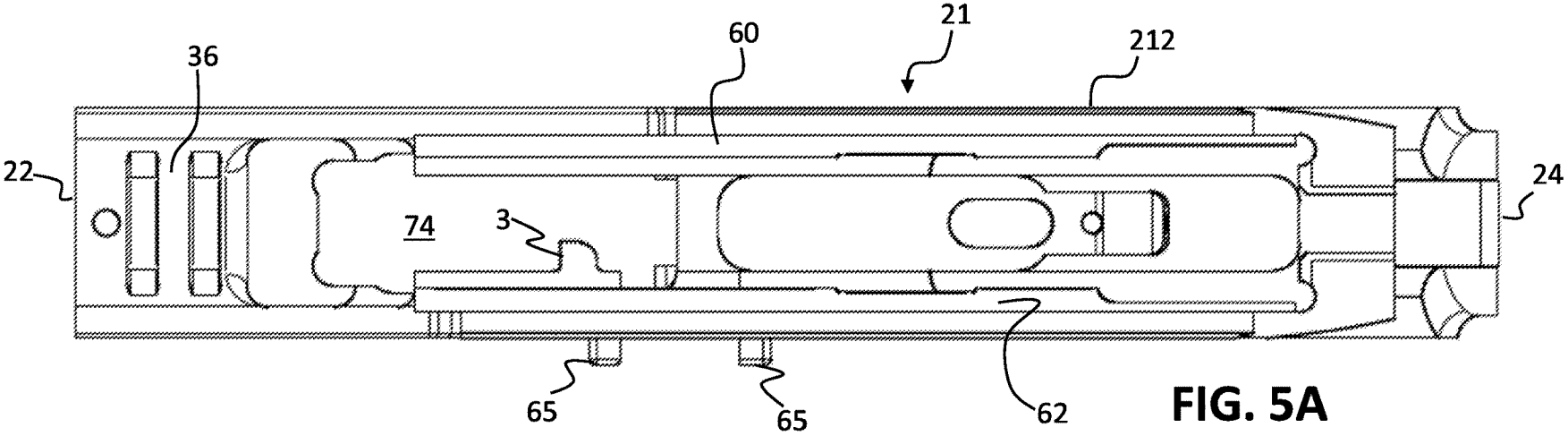
FIG. 5A schematically shows an example of a top view of a hybrid receiver body.

Referring now to FIG. 5A, an example of a top view of a hybrid receiver body is schematically shown. A hybrid receiver 20 includes a magazine well 74, bolt stop pin blocks 65, a back end 24 and a front end 22. The front end 22 includes a trunnion connection section 36. The trunnion connection section 36 is constructed to seat and attach to a trunnion 80 as shown, for example, in FIG. 6. A bolt carrier right rail 60 is attached to the right side of the rear portion 212. A bolt carrier left rail 62 is attached to the left side of the rear portion 212. An ejector member 3 is configured as part of the left rail 62.

Figure 5B:
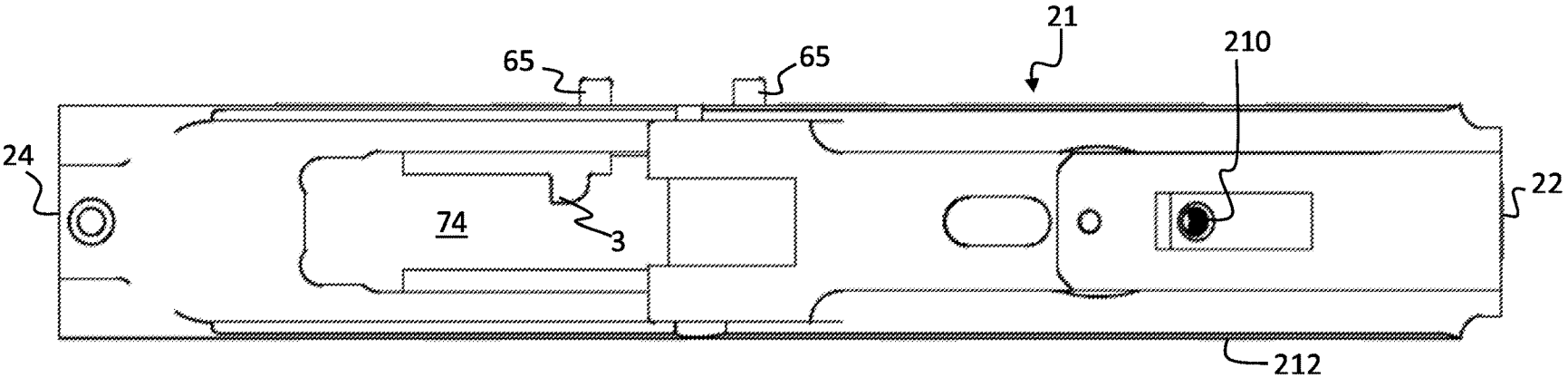
FIG. 5B schematically shows an example of a bottom view of a hybrid receiver body.

Referring now to FIG. 5B, an example of a bottom view of a hybrid receiver body is schematically shown. Hybrid receiver body 21 includes a magazine well 74, bolt stop pin blocks 65, a back end 24 and a front end 22. A threaded circular cavity 210 is located in a rearward portion of the receiver for fastening a handgrip 44 (as shown in FIG. 1, for example).

Referring now to FIG. 6, an exploded view of an example of components assembled into a hybrid receiver including a trunnion is schematically shown. The hybrid receiver 20 is assembled with integral or attached bolt stop pin blocks 65. The trunnion connection section 36 is constructed to seat and attach to the trunnion 80 using trunnion screws 84 or the like. A trunnion receiver mating section 136 (as shown, for example in FIG. 16A) is configured to tightly mate with the trunnion connection section 36 when attached by screws or the like. The bolt carrier right rail 60 is attached to the right side of the rear portion 212 using a plurality of bolt carrier rail screws 64 or the like. A bolt carrier left rail 62 is attached to the left side of the rear portion 212 using a plurality of bolt carrier rail screws 64 or the like. In one example, the receiver 20 includes a main body 19 where the main body 19 may be constructed of aluminum. In order to provide strength and durability, while maintaining an overall receiver light weight with the aluminum main body 19, the right and left rails 60, 62 are advantageously made from steel.

Still referring to FIG. 6 and concurrently to FIG. 16A through FIG. 16G an example of a modified trunnion is schematically shown in a bottom perspective view a top perspective view, a front plan view, a bottom plan view, a side view, top plan view and a back plan view, respectively. Specifically referring to the trunnion 80, a plurality of trunnion screw circular cavities 81 are constructed on the right and left sides to accept the plurality of trunnion screws 84. An operating rod support 86 is integrated into the trunnion 80 to provide support for an operating rod 300 (shown, for example in FIGS. 10 and 13A). The operating rod support 86 includes a circular cavity 87 sized to slidingly accept the operating rod 300 as described in more detail below. Also integrated into the trunnion is a circular threaded connector 89. The circular threaded connector 89 includes a key slot 91 and a circular cavity 93 sized for attaching a rifle barrel, as shown, for example, in FIG. 7. The top of the operating rod support 86 is configured into the trunnion channel 534 which provides added port for the pin 530 as described above with respect to FIG. 1.

An advantage of the design disclosed herein is that by having the larger threaded cylindrical cavity 76 on the same axis as the circular threaded connector 89 on the trunnion is improved accuracy when firing. Since the rifle stock is on the same axis as the barrel it comes straight back against the shoulder when a round is fired instead of rising up. Further, the operating rod support 86 and circular cavity 87 eliminate the need for a gas tube bolt carrier since the operating rod is supported by the operating rod support 86.

Figure 7:
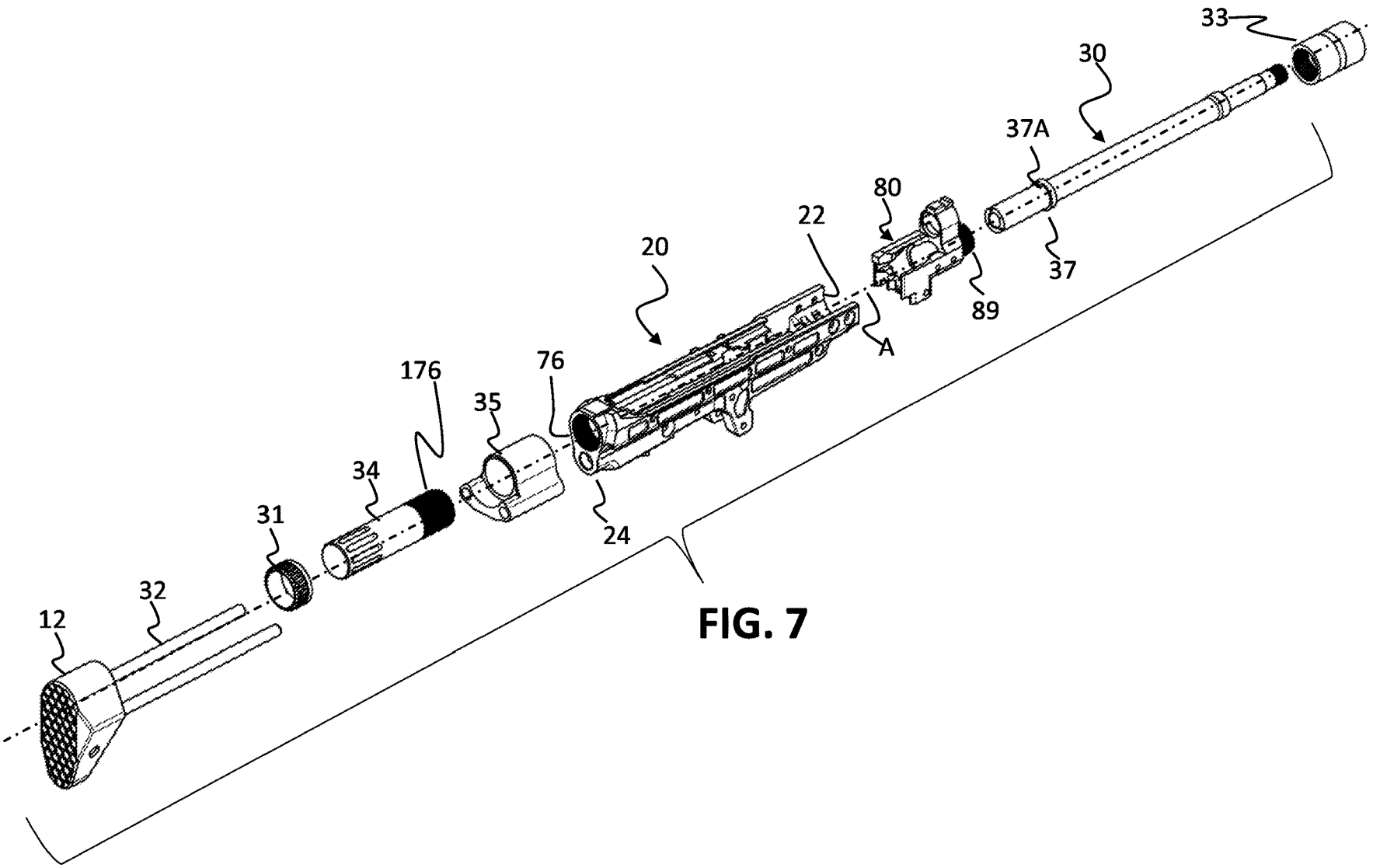
FIG. 7 schematically shows an example of an exploded view of a PDW stock, trunnion and rifle barrel as assembled into a hybrid receiver.

Referring now to FIG. 7, an example of an exploded view of a PDW stock, trunnion and rifle barrel assembled into a hybrid receiver is schematically shown. Major components attached to the hybrid receiver 20 and trunnion 80 are shown in an exploded view. The major components are assembled along a central axis A running through the center of barrel 30 which is centrally aligned with the other components. Connected on the receiver back end 24 are the stock 12 with opposing telescoping bars 32, a buffer tube stock connector 31, a buffer tube 34, and a PDW stock mounting base 35. The stock is coupled to the buffer tube 34 by the buffer tube stock connector 31. The buffer tube is connected to the receiver back end 24 and supported by the PDW stock mounting base 35 with a forward end 176 of the buffer tube being threaded into the threaded circular cavity 76. As described above, the trunnion 80 is attached to the receiver 20 at the front end 22 as described above. The barrel 30 is aligned to the trunnion using the key circular threaded connector 89 to mate with a keyed barrel ring 37 having protruding key 37A which is inserted into the key slot on circular threaded connector 89. A barrel nut 33 secures the barrel by being threaded onto the circular threaded connector 89.

It should be noted that by using a separate barrel nut 33, the barrel can be removed and exchanged with another barrel, having a different caliber sizing, for example. A further advantage of the barrel nut 33 is that it allows a hand guard to be attached to the barrel nut at the front of the trunnion rather than directly to the barrel as is the case of typical rifles of this type. This provides an added advantage because the hand guard will not interfere with the barrel directly.

Figure 8C:
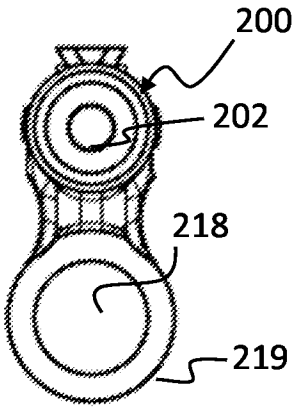
FIG. 8C schematically shows an example of a back view of a modified gas block.
Figure 8B:
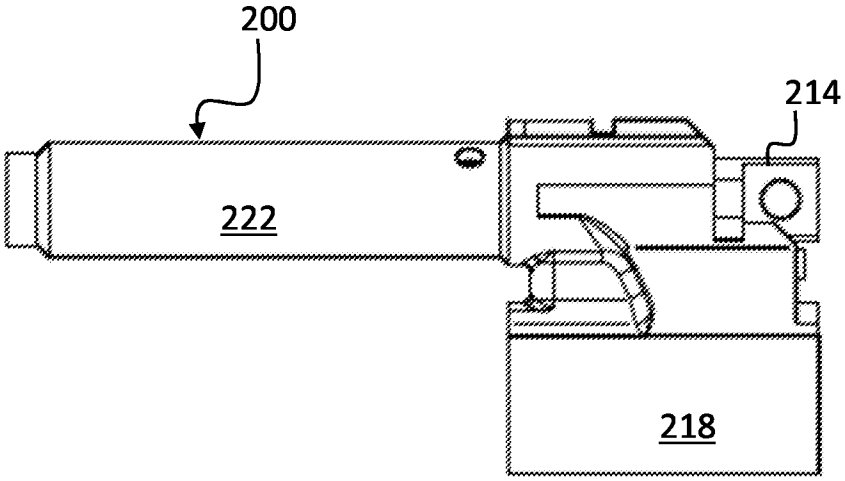
FIG. 8B schematically shows an example of a side view of a modified gas block.
Figure 8D:
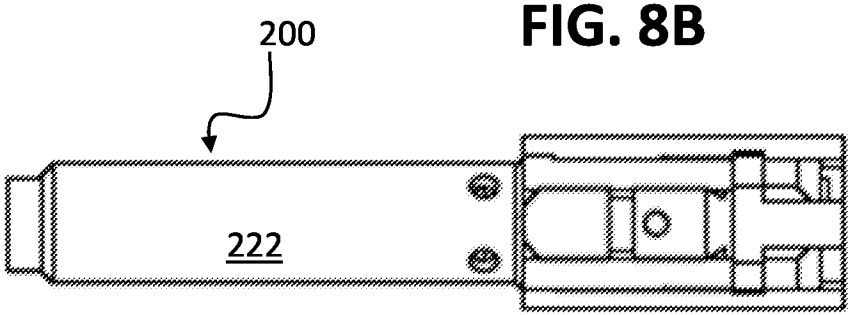
FIG. 8D schematically shows an example of a top view of a modified gas block.
Figure 8A:
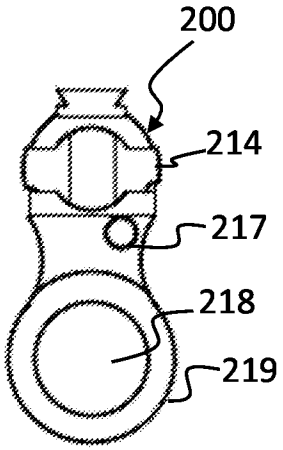
FIG. 8A schematically shows an example of a front view of a modified gas block.

Referring now concurrently to FIG. 8A-8D, an example of a front view, a side view, a back view, and a top view of a modified gas block is schematically shown. A gas block 200 includes a gas block plug 214, a gas block cylinder 216, a gas block barrel pass-through circular cavity 218 and a gas block piston cylinder housing 222. Referring, more particularly to FIG. 8A, the gas block front portion includes a cylindrical cavity 217 for receiving a gas plug retaining pin 204 (as shown in FIG. 9).

Figure 9:
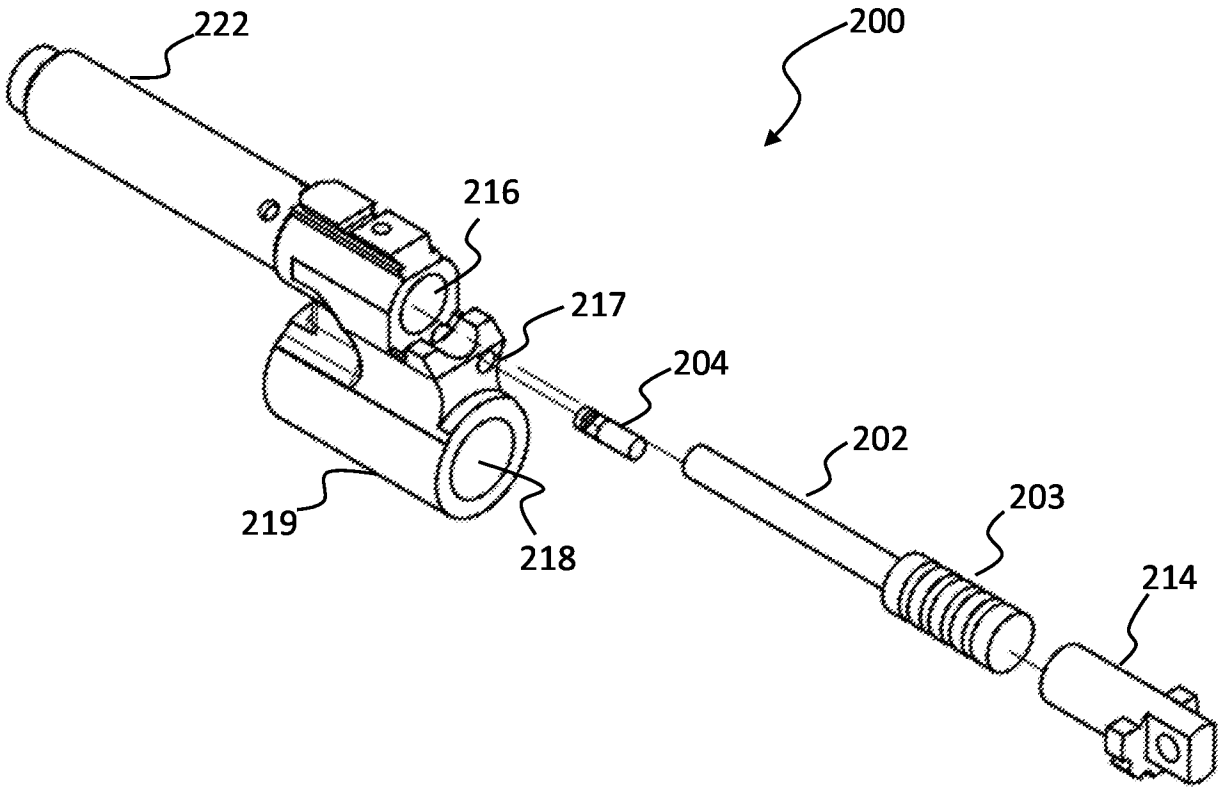
FIG. 9 schematically shows an exploded view of an example of a modified gas block.

Referring now to FIG. 9, an exploded view of an example of a modified gas block is schematically shown. Assembled into the gas plug 200 are a gas plug retaining pin 204 and piston 202 having piston head 203. When assembled the piston is slidingly inserted into gas block cylinder 216 and held at a gas block front end by gas block plug 214.

Figure 9A:
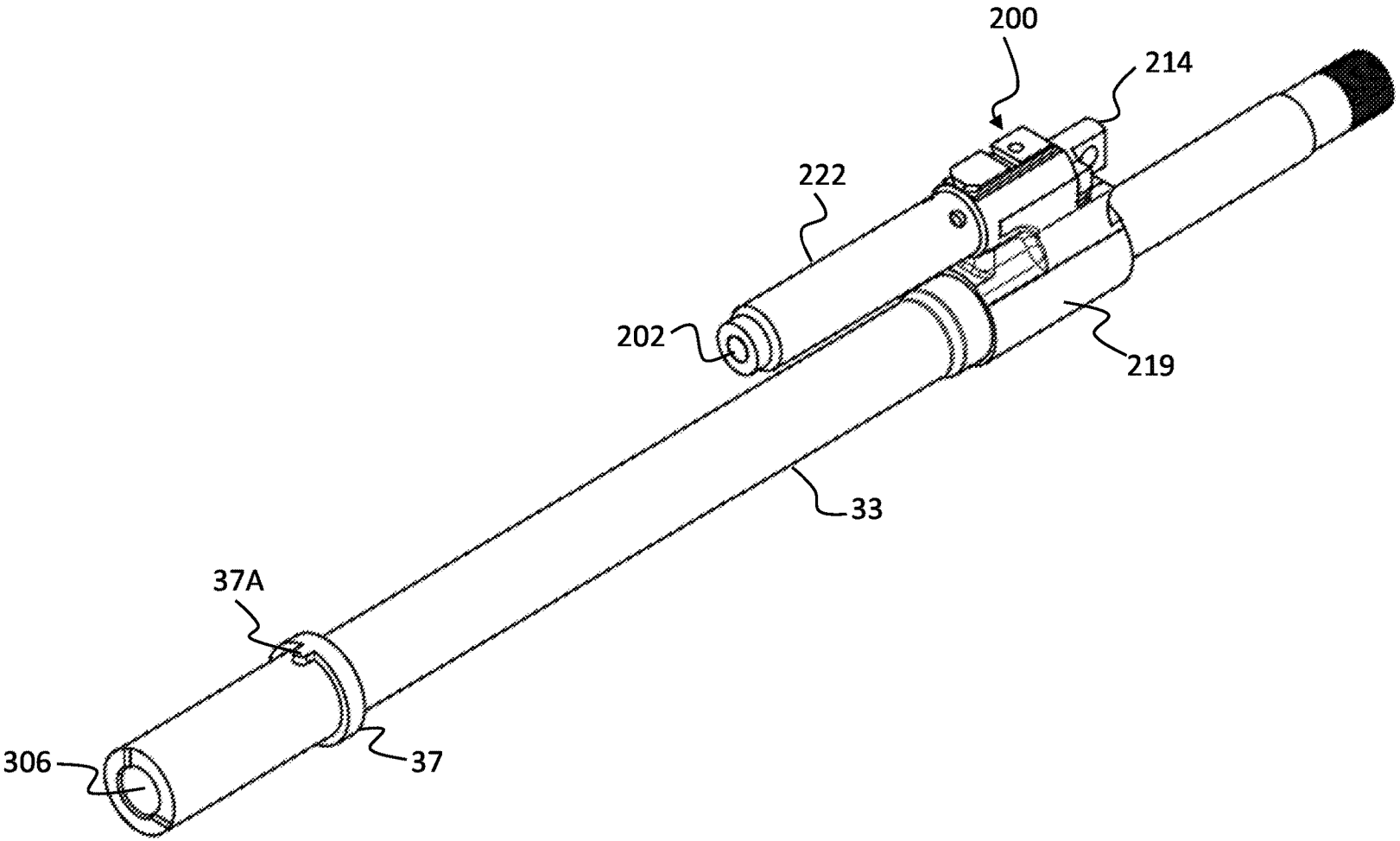
FIG. 9A schematically shows a perspective view of an example of a modified gas block assembled to an AK-style barrel.

Referring now to FIG. 9A, a perspective view of an example of a modified gas block assembled to a rifle barrel is schematically shown. The gas block 200 is assembled to the gas block plug 214, the gas block cylinder housing 222 and the gas block barrel collar 219. The rifle barrel 33 passes through the gas block barrel collar 219 and is adapted to be aligned to the trunnion 80 by means of keyed barrel ring 37 having protruding key element 37A.

Figure 10:
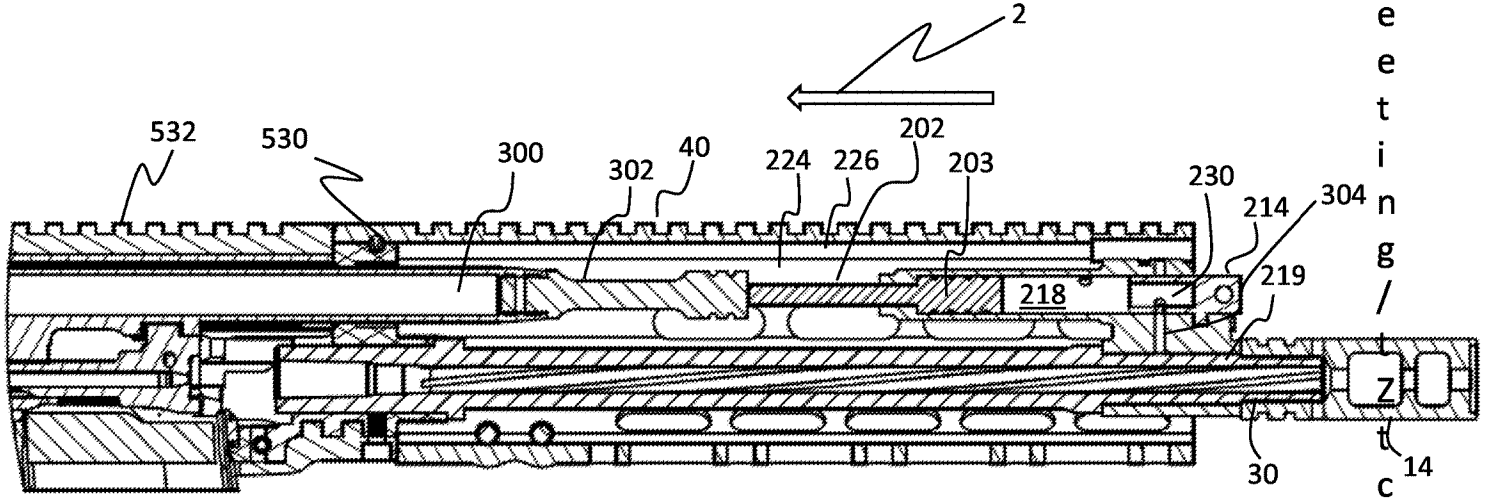
FIG. 10 schematically shows an example of a bolt carrier section including a modified gas block assembled to a rifle barrel in an open position.

Referring now to FIG. 10, an example of a bolt carrier section including a modified gas block assembled to a rifle barrel in an open position is schematically shown. A bolt carrier section 224 includes an operating rod 300 attached to an operating rod extension 302 which is aligned with the gas block piston 202. A gas port 304 provides a conduit between the interior 306 of the barrel 30 and the gas block cylinder 216. In the open position, wherein gas discharges from the barrel into a chamber 230 within the gas block plug 214. The expelled gas from the interior chamber 230 flows into the cylinder 216 and expands forcing piston 203 forward to translate the force linearly against the operating rod extension 302 thereby forcing the operating rod back to ready the rifle for the next round to be fired.

An advantage of this design is that the piston 202 operates as a short stroke piston since it applies a force, as indicated by arrow 2, against the piston that supplies enough momentum to the operating rod to move the operating rod and bolt the full distance required to carry the bolt into the next position for firing. Unlike other AK-style rifles, the piston does not travel the full distance with the operating rod, but need only move about an inch or less within the gas block.

Figure 11:
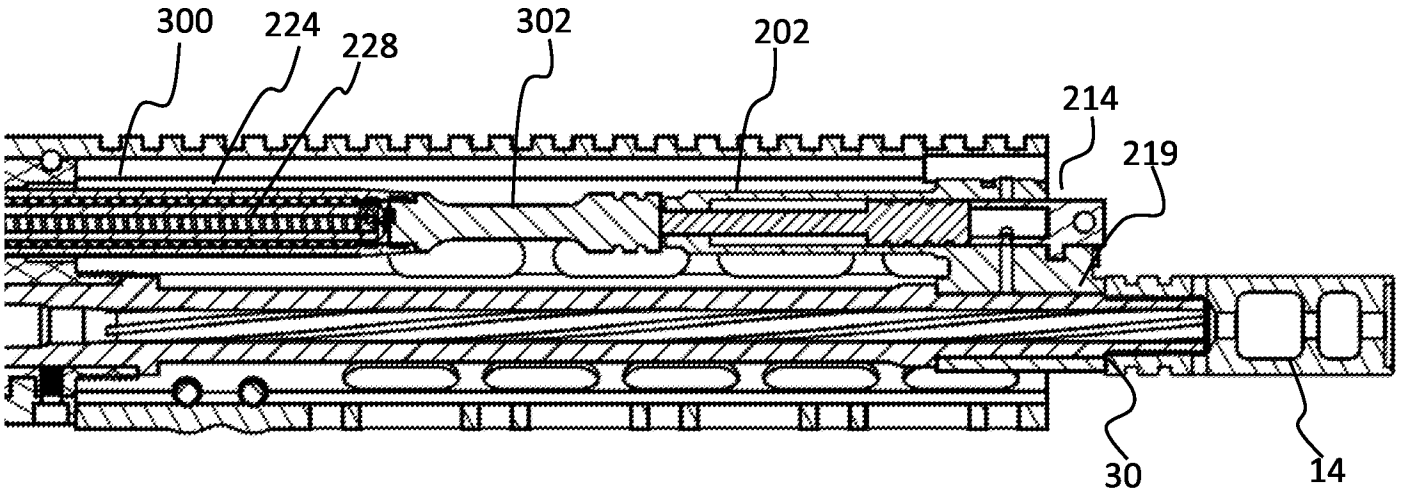
FIG. 11 schematically shows an example of a bolt carrier section including a modified gas block assembled to a rifle barrel in a closed position.

Referring now to FIG. 11, an example of a bolt carrier section including a modified gas block assembled to a rifle barrel in a closed position is schematically shown. The operating rod 300 houses a recoil spring 228 which provides a recoil force to move the piston 202 into a closed position when the rifle is fired. Upon firing, gases again expelled from the barrel 30 pushing the piston 202 into the open position again. The cycle continues until firing ceases. The operating rod 300, piston 202 and gas block plug 214 are linearly aligned substantially horizontal to the barrel 30.

Figure 12A:
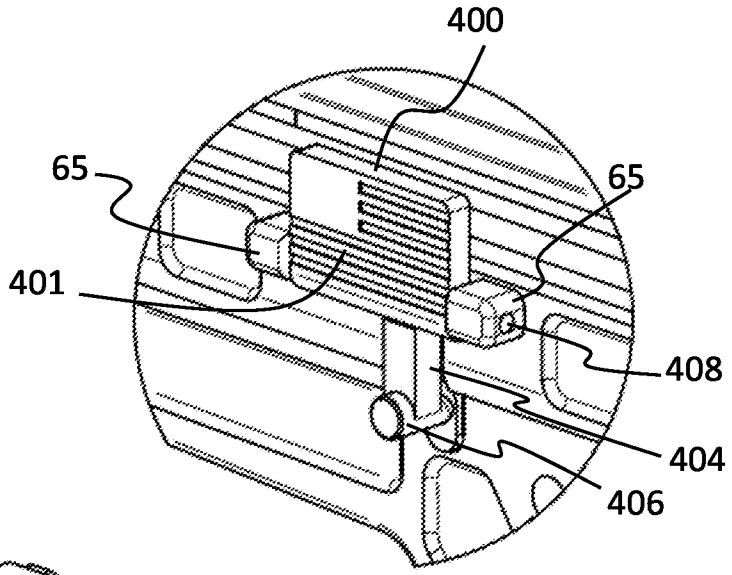
FIG. 12A schematically shows an expanded view of the bolt stop of FIG. 12.
Figure 12:
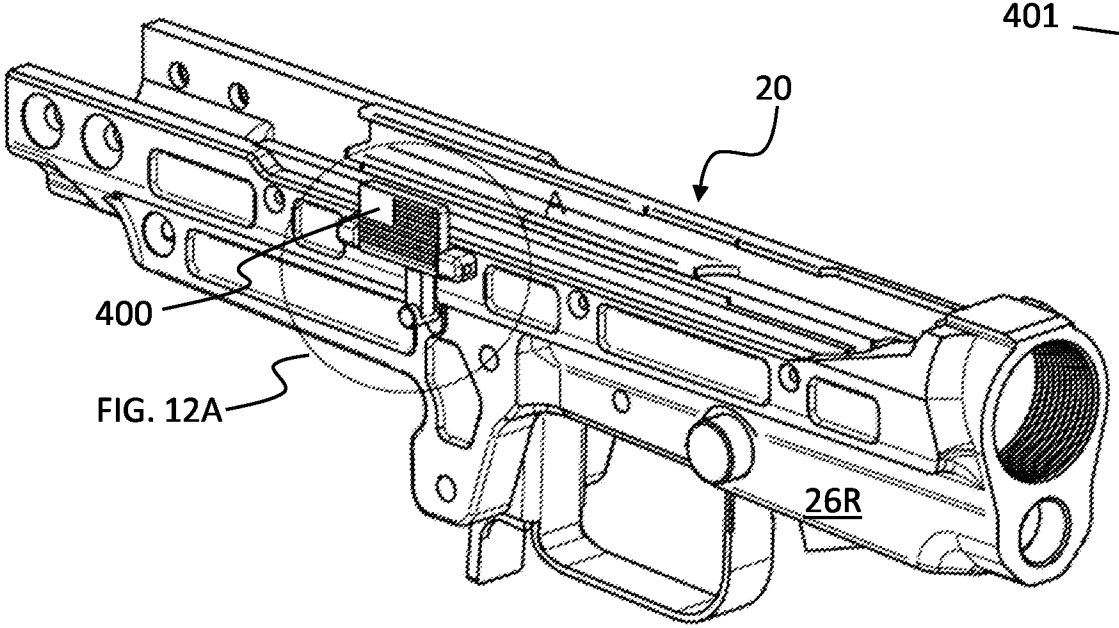
FIG. 12 schematically shows a hybrid receiver with a bolt stop mounted thereon.

Referring now to FIG. 12, a hybrid carrier with a bolt stop mounted thereon is schematically shown. The hybrid carrier 20 has a bolt stop button 400 mounted rearward of the magazine well.

Referring now to FIG. 12A, an expanded view of the bolt stop of FIG. 12 is schematically shown. The bolt stop 400 is mounted between the pair of bolt stop pin blocks 65 and held in place by pinion 408 which is inserted through both pin blocks 65 and the bottom of the bolt stop.

Referring now concurrently to FIG. 12B through FIG. 12F the bolt stop is shown in a side view, a bottom plan view, a front plan view, a top view, and a perspective view, respectively. The bolt stop 400 includes an outer wall 413 having a haptic surface 401, an actuator arm 404 that extends between the bottom of the bolt stop and a bolt stop actuator member 406. A pinion cavity 408A extends through the bolt stop located proximate the area where the bolt stop arm 410 joins the outer wall 413.

Figure 13:
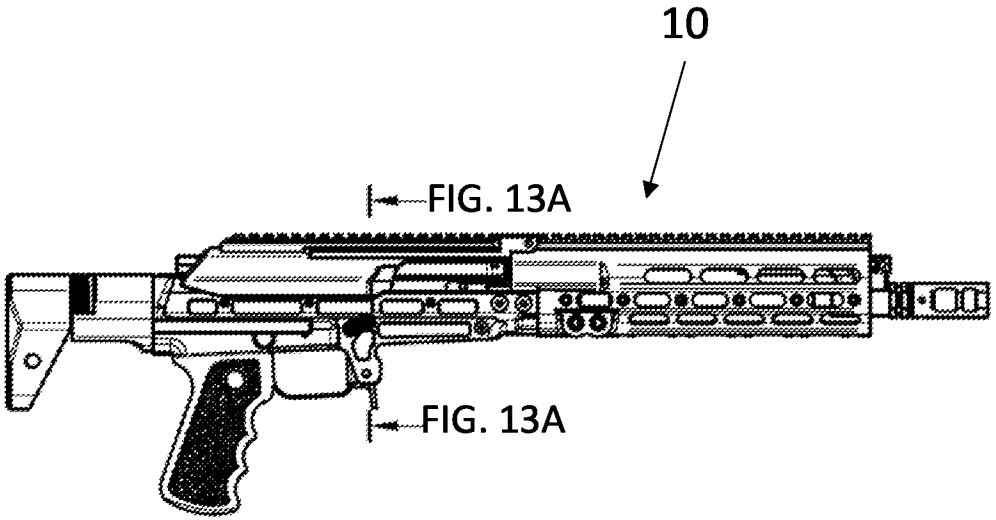
FIG. 13 schematically shows a modified rifle indicating the cutaway view of FIG. 13A.
Figure 13A:
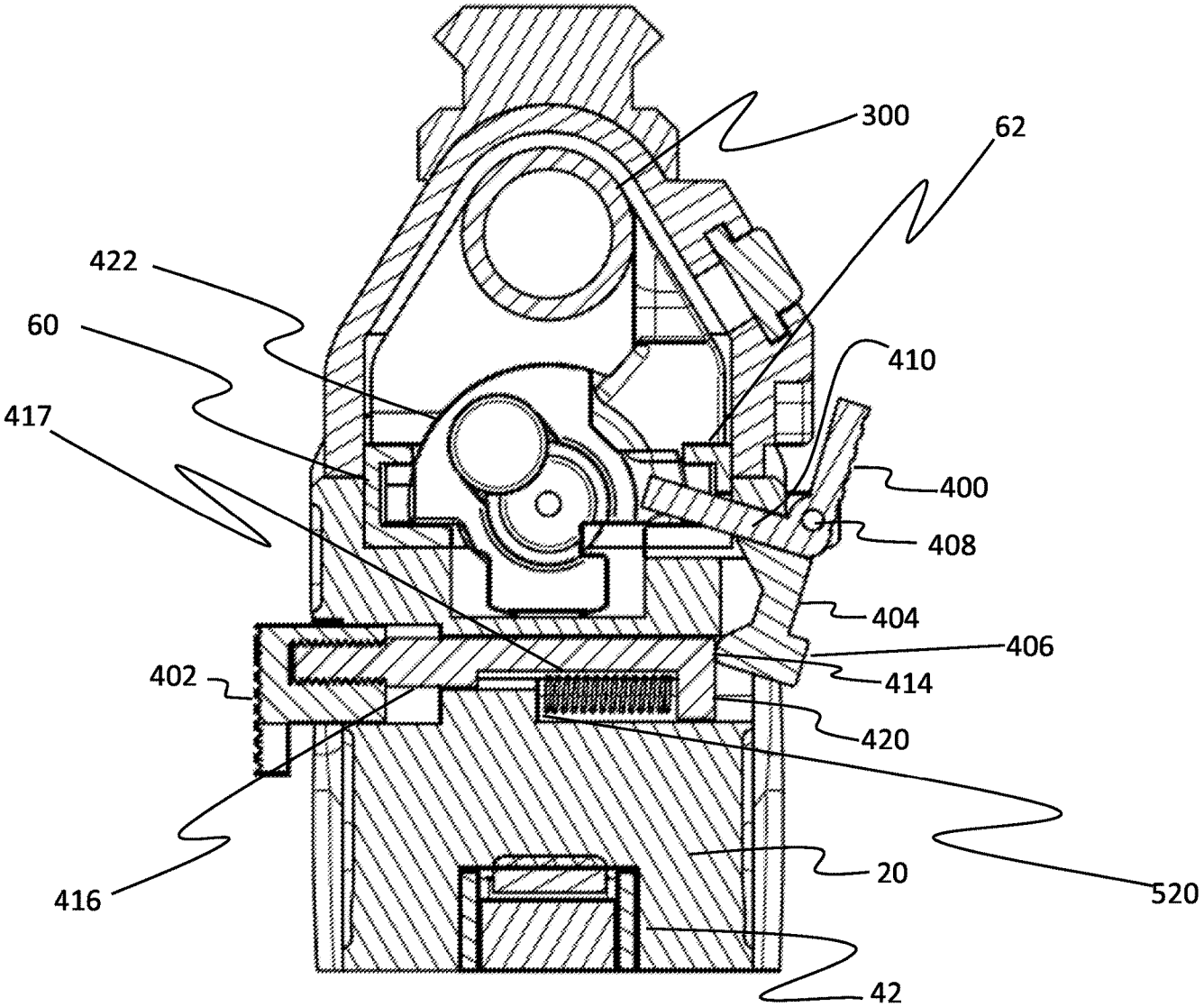
FIG. 13A schematically shows a cutaway view of a modified carrier and magazine for illustrating the relationship between the bolt release and the bolt stop.

Referring now to FIG. 13, a modified rifle indicating the cutaway view of FIG. 13A is shown.

Referring now specifically to FIG. 13A, a cutaway view of a modified carrier and magazine for illustrating the relationship between the bolt stop and the bolt stop actuator is schematically shown. A bolt 422 is supported by right and left bolt carrier rails 60,62. The bolt stop 400 further includes a bolt stop arm 410 here shown in the blocking position. The actuator arm 404 has a top end, a bottom end, and an actuator 404 having an actuator surface 414 that impinges on slidable horizontal member 416. The bolt release 402 is attached to a right side of the horizontal member 416. The bolt stop 400 outer wall 413 extends outwardly from the hybrid receiver surface 26L when the bolt is in the blocked mode. A compression spring 417 is held between a downward extension 420 of the slidable horizontal member 416 and a wall portion 520 of the receiver 20.

Figure 14:
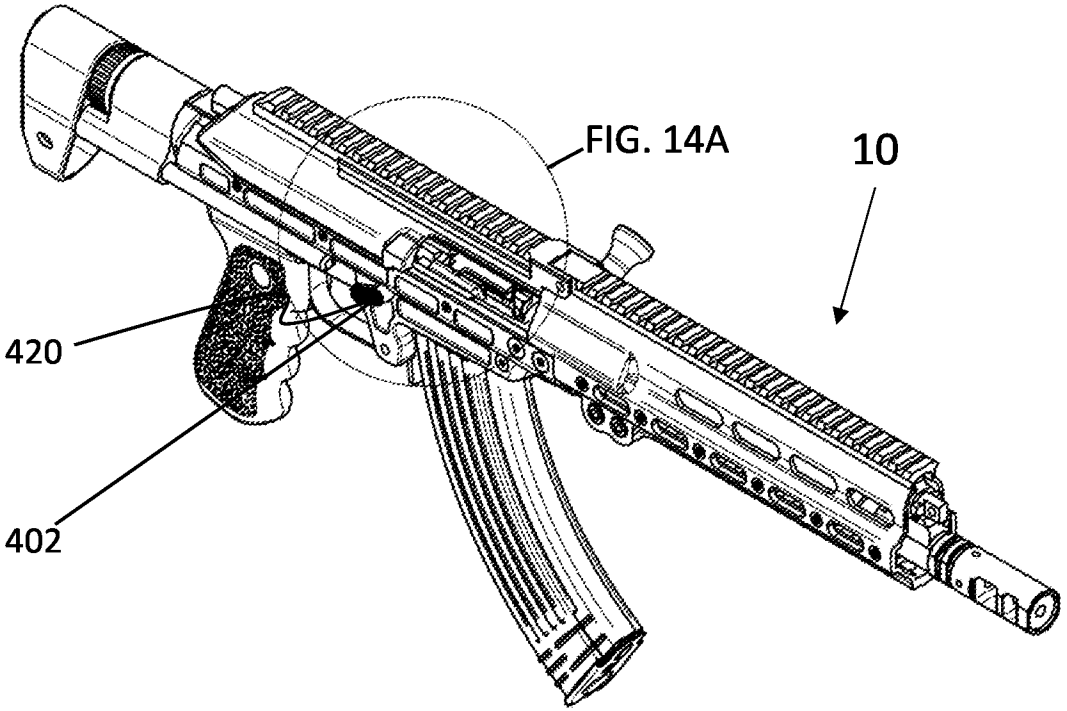
FIG. 14 schematically shows a modified rifle featuring the bolt release.
Figure 14A:
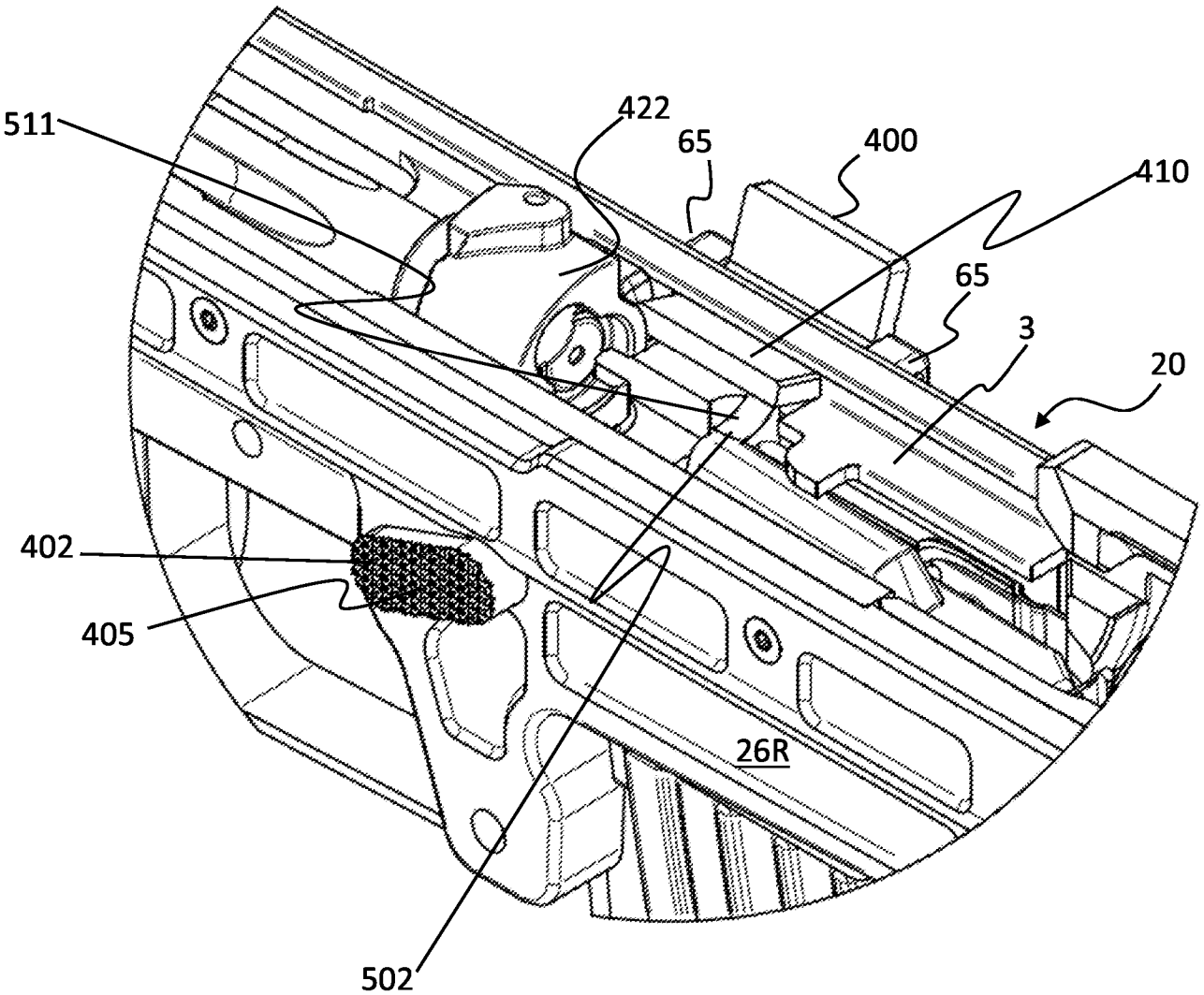
FIG. 14A schematically shows an expanded view of the bolt release as shown in FIG. 14.

Referring now jointly to FIG. 14 showing a modified rifle featuring the bolt release and FIG. 14A showing an expanded view of the bolt release as shown in FIG. 14. The bolt release 402 is mounted to the right hybrid receiver wall 26R by attachment to the slidable horizontal member 416. The bolt release 402 has a haptic surface 405 which extends outwardly from the wall 26R when the bolt is in the blocked mode. An extractor member 3 of the left bolt carrier rail serves to operate in a conventional manner in connection with the bolt 422. As discussed below with reference to FIG. 15, a magazine follower 502 includes a protruding actuating member 511. The protruding actuating member 511 operates on the bolt stop arm 410 to push it upwards to lock the bolt 422.

Figure 15:
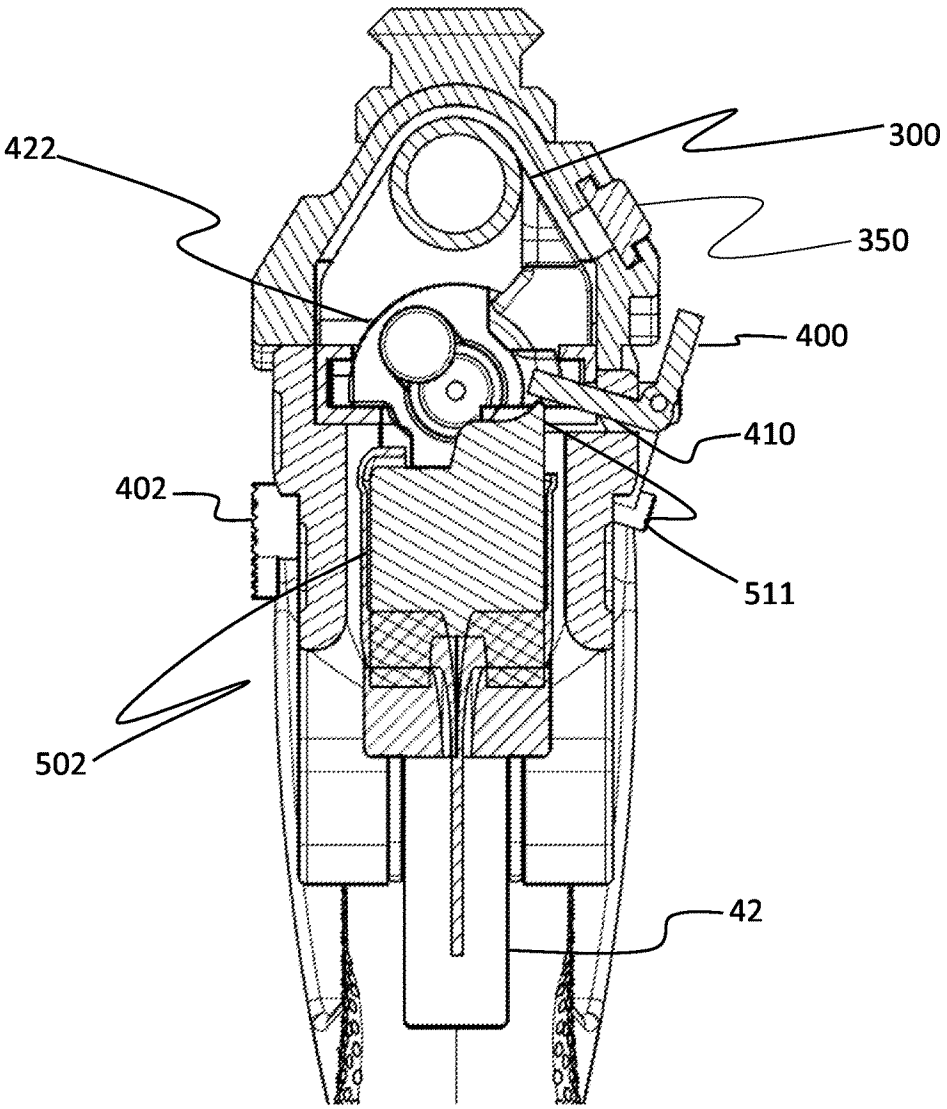
FIG. 15 schematically shows a cutaway view of a carrier and a magazine to illustrate the cooperative operation of the ambidextrous bolt stop and a magazine follower.

Referring now specifically to FIG. 15, a cutaway view of a carrier and a magazine to illustrate the cooperative operation of the ambidextrous bolt stop and a magazine follower is schematically shown. The features shown are similar to FIG. 14A above, the magazine follower 502 is shown having a protruding actuating member 511 that impinges with an upward force on the bolt stop arm 410 when the magazine 42 is depleted of ammunition. The upward force causes the bolt stop to block the bolt so that the expended magazine can be replaced. Once a new magazine is installed, the operator can slide the charging handle 350 to resume firing.

Having explained the structure of the bolt block it will now be helpful to the understanding of the modified rifle to describe the operation. In operation, when a magazine is expelling rounds it pushes rounds upwardly until a last round is expelled and fired. In that event, a magazine follower 502 impinges on the underside of the bolt block arm 410, thereby outwardly extending both the right and bolt stop buttons. An operator can then replace the expended magazine with a new magazine while the bolt is held in place by the bolt block arm. The operator can then use either the right or left hand to release the bolt by depressing either the bolt stop 400 or the bolt release 402. In this way the bolt block is an ambidextrous bolt block allowing for quick exchange of magazines as required in some situations.

In one example a modified AK-style rifle includes a receiver body including a front end, a back end, a first side wall and a second side wall parallel to and opposite the first side wall; wherein the back end includes a first threaded cylindrical cavity and a second cylindrical cavity located below the first threaded cylindrical cavity, and wherein a lower portion of the receiver walls below the first threaded cylindrical cavity have a width that is narrower than the upper receiver section constructed to allow for passage of one of a pair of parallel and opposing telescoping bars on each side of the receiver; opposing magazine guides constructed to be parallel to each other and spaced apart to accommodate supporting a magazine release between them; a trunnion connected to the receiver front end; an ambidextrous bolt stop attached to the receiver body; a removable stock coupled to the first threaded cylindrical cavity; a rifle barrel with a rearward end connected to the trunnion; a muzzle attached to the forward end of the rifle barrel; a magazine well integrated into the receiver body; a first bolt carrier rail attached to a first side wall of the receiver body and a second bolt carrier rail attached to the second side wall of the receiver body; a bolt carrier slidingly bearing on the first bolt carrier rail and the second bolt carrier rail; a gas block attached to the rifle barrel, wherein the gas block includes a short stroke gas piston aligned with the bolt carrier section; and a pistol grip attached to a bottom surface of the receiver body.

In another example, the opposing magazine guides are integrated into the receiver body and wherein each protrude downwardly from the receiver body slanted towards the front end such that the slant is slightly greater than 90° with respect to a central axis extending through a center of the first threaded cylindrical cavity, the axis being perpendicular to the front and back surfaces.

In another example, the removable stock comprises a collapsing or telescoping AR-style PDW stock attached to a rearward end of a buffer tube, and where the buffer tube has a forward end attached to the back end of the receiver body.

In another example, the PDW stock includes a parallel pair of telescoping rods where a right telescoping rod is extendable along the receiver first side wall and a left telescoping rod is extendable along the receiver second side wall.

In another example, a hand guard is installed around the receiver body.

In another example, the first bolt carrier rail and the second bolt carrier rail are separate pieces attached by fasteners to the receiver body wherein each substantially comprises steel and wherein the receiver body substantially comprises aluminum.

In another example, an operating rod support is integrated into the trunnion and is constructed to provide support for an operating rod.

In another example, the trunnion comprises a keyed circular threaded connector constructed to connect a rifle barrel.

In another example, the rifle barrel is encompassed by a keyed circular threaded connector configured to align the rifle barrel to the trunnion keyed circular threaded connector.

In another example, the gas block comprises: a gas block piston cylinder housing; a gas block plug fitted into a forward end of the gas block piston cylinder housing; a gas block cylinder aligned in fluid communication with the gas block plug; a gas block barrel pass-through circular cavity for supporting the rifle barrel; and a short stroke piston slidingly contained in the gas block cylinder.

In yet another example, the piston includes a piston head positioned proximate to a forward end of the gas block cylinder housing proximate the gas block plug.

In another example, the bolt carrier section comprises an operating rod attached to an operating rod extension aligned with the gas block piston.

In another example, the gas block comprises a gas port configured to provide a conduit between an interior of the rifle barrel and the gas block cylinder.

In another example, the ambidextrous bolt stop comprises a bolt stop mounted on a first side of the receiver body and a bolt release mechanically coupled to the bolt stop and mounted on a second side of the receiver body opposite the first side.

In another example, the ambidextrous bolt stop comprises: a bolt block arm attached to the bolt stop; a bolt release coupled against the second receiver wall; a slidable horizontal member within the receiver body configured to mechanically couple the bolt release and the bolt stop; an actuator attached at an acute angle to the bolt block arm having a surface that impinges on the slidable horizontal member; where the bolt stop is attached to the second side of the slidable horizontal member; a bolt stop spring held between the receiver body and an inside wall of the slidable horizontal member; and wherein the bolt stop is configured to block the rifle bolt when force is applied by a magazine follower.

In another example, a hybrid receiver for a modified AK-style rifle includes a receiver body including a front end, a back end, a first side wall and a second side wall; a first threaded cylindrical cavity in an upper receiver section and a second cylindrical cavity located below the first threaded cylindrical cavity constructed on the back end; a right lower portion of the first side wall opposite a left lower portion of the second side wall below the first threaded cylindrical cavity wherein the width between the right lower portion and the left lower portion is narrower than the upper receiver section and each is constructed to allow for passage of one of a pair of parallel and opposing telescoping bars; and a trunnion connection section constructed proximate the receiver front end.

Certain exemplary embodiments of the invention have been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. A firearm comprising:

a frame defining a bolt channel and having a forward end;

a bolt assembly received in the bolt channel and having a bolt defining a bolt axis;

the bolt assembly having a cylindrical operating rod portion above the bolt axis and extending in a forward direction;

a trunnion connected to the frame at the forward end;

the trunnion including a barrel mounting facility registered with the bolt axis;

the trunnion defining an operating rod bore above the barrel mounting facility and configured to closely and slidably receive the operating rod portion;

a barrel having a gas block defining a cylindrical bore registered with the operating rod bore, and a piston received in the bore and having a rear end portion operable contacting the operating rod portion, and wherein the firearm is free of a gas tube.

2. The firearm of claim 1 wherein the frame is made of a first material and the trunnion is made of a second material.

3. The firearm of claim 2 wherein the first material is aluminum.

4. The firearm of claim 2 wherein the second material is steel.

5. The firearm of claim 1 wherein the trunnion has a rear facing stop surface configured to abut a portion of the frame.

6. The firearm of claim 1 wherein the stop surface is positioned on a lower face of the trunnion.

7. The firearm of claim 1 wherein the operating rod portion extends forward of the trunnion.

8. The firearm of claim 1 wherein the piston directly contacts the operating rod portion.

9. The firearm of claim 1 wherein the operating rod portion and the trunnion are the same material.

10. The firearm of claim 9 wherein the same material is steel.

11. The firearm of claim 1 wherein the operating rod portion and the frame are different materials.

* * * * *